United States Patent [19]

Brown

[11] Patent Number: 4,858,582

[45] Date of Patent: Aug. 22, 1989

[54] CARBURETOR FUEL PRECONDITIONER

[76] Inventor: Paul M. Brown, 10492 Summerwind, Boise, Id. 83704

[21] Appl. No.: 216,960

[22] Filed: Jul. 11, 1988

[51] Int. Cl.[4] ..... F02M 17/26

[52] U.S. Cl. ..... 123/523; 123/1 A; 48/144; 48/180.1; 261/DIG. 83

[58] Field of Search ..... 123/523, 522, 262, 1 A; 48/219, 180.1, 144; 261/DIG. 83

[56] References Cited

U.S. PATENT DOCUMENTS

| | | | |
|---|---|---|---|
| 1,938,497 | 12/1933 | Pogue | 261/DIG. 83 |
| 2,122,683 | 7/1938 | Faverty | 48/144 |
| 3,918,412 | 11/1975 | Lindstrom | 123/3 |
| 3,989,477 | 11/1976 | Wilson et al. | 48/219 |
| 4,076,002 | 2/1978 | Mellqvist et al. | 123/25 L |
| 4,090,838 | 5/1978 | Schena et al. | 123/25 R |
| 4,285,886 | 8/1981 | Delfino | 123/522 |
| 4,368,711 | 1/1983 | Allen | 123/522 |
| 4,397,286 | 8/1983 | Jackson et al. | 123/523 |
| 4,412,521 | 11/1983 | Silva, Jr. | 123/522 |
| 4,426,984 | 1/1984 | Gilbert | 123/522 |

FOREIGN PATENT DOCUMENTS 2042076 9/1980 United Kingdom ..... 261/DIG. 83

*Primary Examiner*—E. Rollins Cross
*Attorney, Agent, or Firm*—Paul Horton

[57] ABSTRACT

A carburetor-fuel preconditioner for internal combustion engines comprising a bubble chamber for holding fuel at a preselected level and for bubbling air therethrough; a multiplicity of catalytic beads located within the bubble chamber in contact with gasoline fuel for producing an air-fuel vapor mixture and for the catalytic cracking of long molecular hydrocarbon chains; and at least one air-fuel vapor mixing conduit located between the bubble chamber and the intake manifold of the engine to provide proper air-fuel ratio to the vapor entering the engine cylinders. A screen may be provided in the bubble chamber to prevent dislocation of the catalytic beads. Each mixing conduit is provided with a plurality of peripherally spaced baffles for creating an air-fuel vortex for superior mixing.

12 Claims, 2 Drawing Sheets

FIG. 3
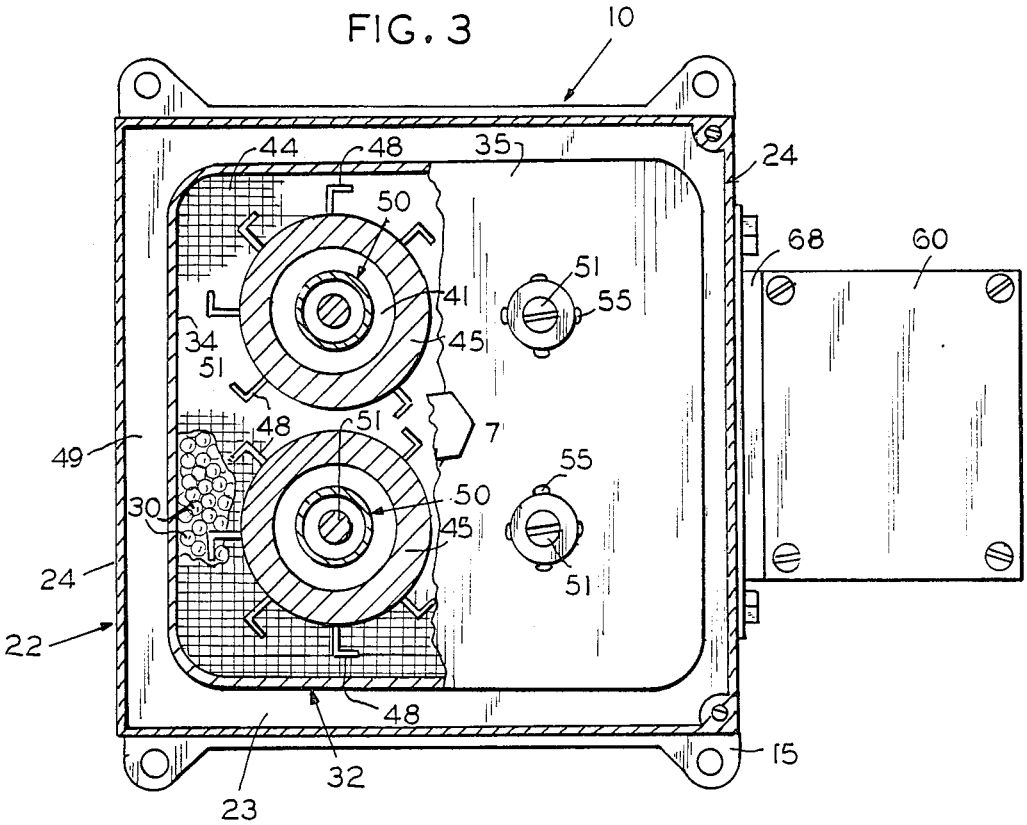
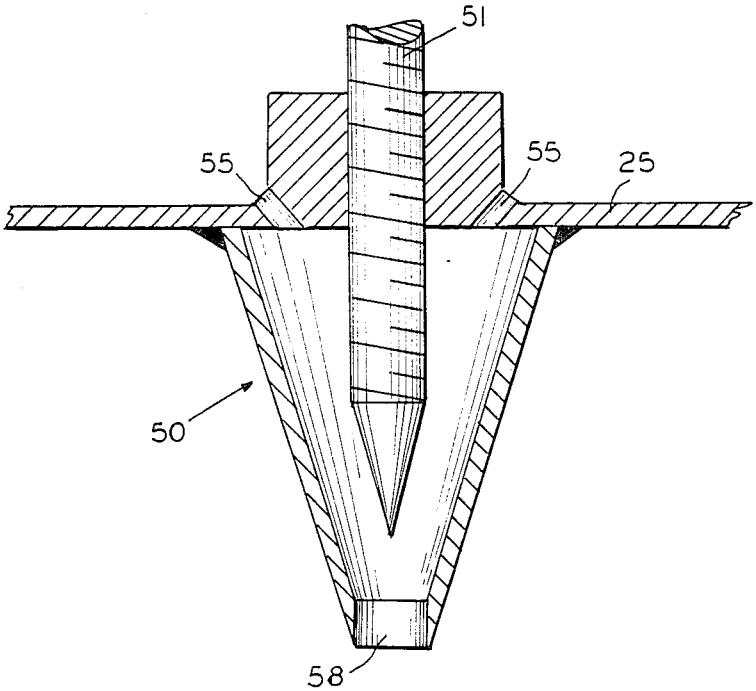
FIG. 4

CARBURETOR FUEL PRECONDITIONER

BACKGROUND OF THE INVENTION

1. Field of the Invention

This invention relates in general to internal combustion engines and more particularly to fuel preconditioners and carburetors which, when applied to motor vehicles, obviates the need for conventional carburetors and enables vastly improved gasoline mileage to be obtained while providing reduced pollutant emissions. Even more particularly, the present invention relates to catalytic preconditioners.

2. Description of the Prior Art

It is highly desirable that gasoline fuel entering the intake manifold of an internal combustion engine be in the form of a vapor which is well mixed with air at a selected ratio. It is also highly desirable that the fuel be catalyzed to the shortest molecular chains possible immediately before injection into the cylinders to maximize efficiency.

Various types of fuel-air mixing chambers are described in the prior art, including systems designed for mixing and warming air and atomized fuel to provide a highly combustible mixture of fuel and air. However, the tendency to experience incomplete combustion of fuel and air mixtures continues to cause problems for designers of internal combustion engines, particularly those engaged in the research and design of systems to reduce the level of atmospheric contamination. In this regard, incomplete combustion has long been recognized as a primary source of noxious gases which contaminate the atmosphere.

The injection of fuel droplets into the cylinders results in incomplete combustion in that only the fuel molecules on the exterior surface of the droplet mix properly with oxygen for complete combustion. All internal molecules of the droplet are oxygen starved and are exhausted as unburned hydrocarbons to pollute the atmosphere. Devices, as typified by U.S. Pat. No. 4,452,215, issued to J. W. Glass, have been devised to provide a solution to this problem. Such devices generally require optimum temperature stabilization or introduce water or steam to effectuate proper vaporization.

Accordingly, while there currently exists a need for an improved practical system which is readily employable in preconditioning fuel-air mixtures, and which is particularly suited for preheating and homogenizing fuel-air mixtures while employing a minimum of movable parts, no practical system has yet found its way to the marketplace.

The chemically correct air/fuel mixture for total burning of gasoline has been determined to be 15 parts air to one part gasoline or 15/1 by weight. Changing this to a volume ratio yields 8000 parts air to one part gasoline or 8,000/1 by volume. The system of the present invention vaporizes liquid fuel before the fuel enters the engine. Theoretically, a homogenous mixture can yield gas mileage in excess of 300 miles per gallon. The world record for auto gas mileage was sent in October 1973 by a 1959 Opel station wagon with a highly modified engine. The car traveled 376.59 miles on a single gallon of gasoline during a Shell Oil Co. contest at Wood River, Ill.

The use of catalysts to increase octane for superior combustion is also well known. Catalysts are used in catalytic converters to break down molecular chains for burning, but such use does not produce useable energy.

A number of inventions, including U.S. Pat. No. 3,481,317, issued to J. C. Hughes et al; U.S. Pat. No. 4,223,645, issued to H. Nohira et al; U.S. Pat. No. 4,369,746, issued to R. H. Thring and U.S. Pat. No. 4,559,911 issued to A. G. Bodine, provide catalytic combustion for improving efficiency. U.S. Pat. No. 4,295,816, issued to B. J. Robinson utilizes a soluble catalyst which is injected into the cylinders for the same purpose. Catalytic cracking is also well known in the production of gasoline. The octane number of straight run cracked stocks can be increased by catalytic forming, generally over a platinum containing catalyst which isomerizes cyclopentanes to cyclohexanes and dehydrogenates naphthenes to aromatics. Cracking continues until a desired composition of paraffins, napthenes; olefins, aromatics, etc., are obtained. Excessive cracking results in production of excessive amounts of highly volatile gaseous products which are highly desirable for combustion but not desirable for handling, storage, and dispensing purposes. All known vaporization preconditioners and catalytic preconditioners require a separate carburetor.

SUMMARY OF THE INVENTION

The present invention overcomes the problems of temperature stabilization associated with vapor injection systems by providing a carburetor which is also a preconditioner of gasoline fuel by providing a fuel vapor-air ratio of proper mixture. The fuel vapor-air mixture is created by the device of the present invention which includes a bubble chamber, holding a selected level of gasoline, through which air is pulled by the vacuum of the intake manifold and a multiplicity of catalytic beads, contained within the bubble chamber and immersed in the gasoline to provide an extensive absorption area for both air and fuel for the microscopic mixing of air and fuel vapors.

Contact between the gasoline and the catalytic beads, preferably of platinum, also results, it is believed, in further catalytic cracking of molecular chains of gasoline components to raise the volatility and octane of the fuel for greater combustion efficiency.

The present invention also provides venturi type mixing tubes, each having a plurality of peripherally spaced deflection members, each set at a selected angle to create an air-fuel vapor vortex for superior mixing of fuel and air entering through needle type mixing valves.

Accordingly, it is a primary object of the present invention to provide a new and improved fuel economy system for an internal combustion engine which greatly improves the efficiency of the engine.

Another object of the present invention is to provide a unique fuel economy system for an internal combustion engine which provides a practical, operable and readily realizable means for dramatically increasing the gas mileage of conventional motor vehicles.

It is also an object of the present invention to provide an improved fuel economy system for internal combustion engines which also reduces the pollutant emissions.

Additional objects and advantages will become apparent and a more thorough and comprehensive understanding may be had from the following description taken in conjunction with the accompanying drawings forming a part of this specification.

BRIEF DESCRIPTION OF THE DRAWINGS

FIG. 3 is a sectional view taken along lines 2—2 of FIG. 1.

FIG. 4 is a detail in section of the air mixing valve.

DETAILED DESCRIPTION OF THE INVENTION

Figure 1:
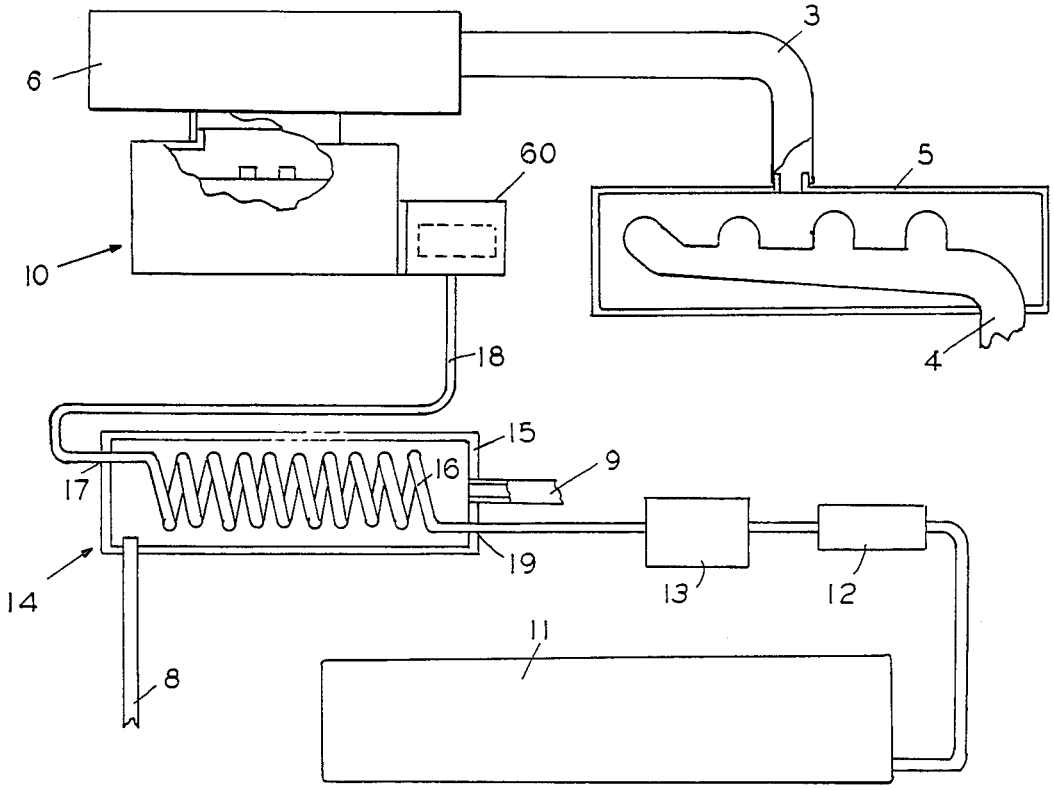
FIG. 1 of the drawings shows a schematic representation of the vaporized liquid fuel system of the present invention.

Referring first to FIG. 1, a schematic showing carburetor-fuel preconditioner 10 in a fuel system for an internal combustion engine is shown. Fuel, coming from fuel tank 11 is pumped through a filter 12 by fuel pump 13 into a liquid fuel preheater assembly 14 before entering fuel bowl 60 through conduit 18. Preheater 14 includes a copper cylinder 15 with spiral tubing 16 as conduit for the fuel which enters through fuel inlet 19 and exits through fuel exit 17. Hot engine coolant enters the cylinder 15 at inlet 8; passes through the cylinder in heat exchange relation with tubing 16, exiting through outlet 9. Air entering carburetor-fuel preconditioner 10 is first pulled through a cylinder 5 where the air is heated in being in heat exchange relation with an exhaust manifold 4; through conduit 3 and through air filter 6.

Figure 2:
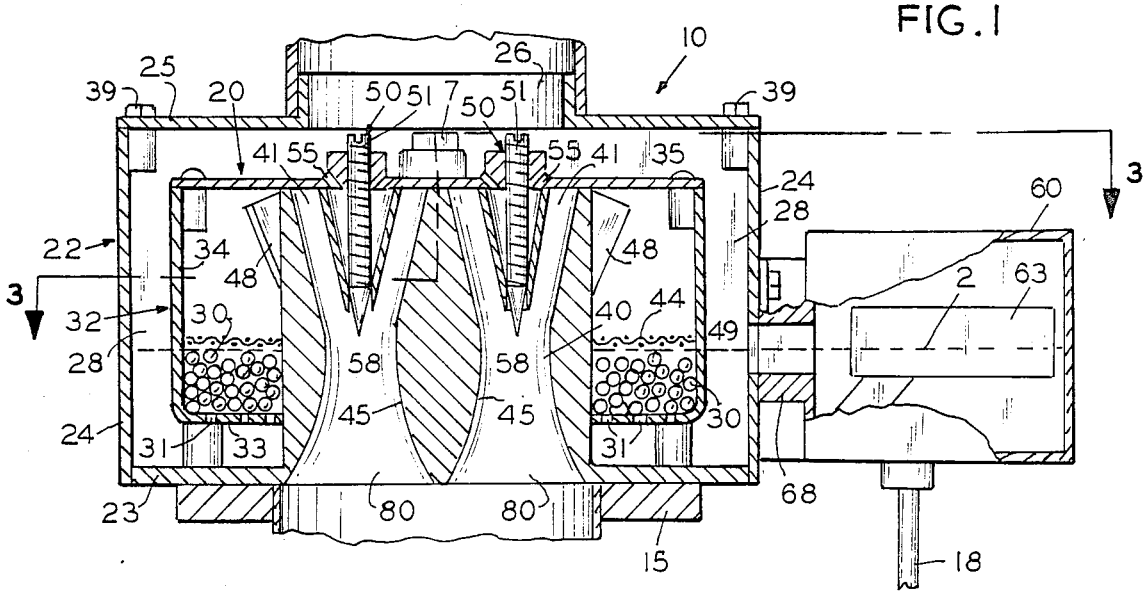
FIG. 2 is a cross-sectional view of the carburetor-fuel preconditioner of the present invention, also showing the float bowl.

Referring again to the drawings, and to FIGS. 2 and 3 in particular, an embodiment to be preferred of carburetor-fuel preconditioner 10 made according to the present invention is disclosed. Device 10 includes, generally, a bubble chamber 20; an air-fuel mixing conduit designated generally by the numeral 40; and one or more mixing conduits 41 with mixing valves 50. A float bowl for maintaining a selected level of fuel 2, indicated by dotted lines, is designated by the numeral 60.

Bubble chamber 20 preferably includes an external housing 22 and an internal housing 32. External housing 22 is box-like in structure, having a bottom wall 23, a side wall 24, and a top wall 25 defining a top opening 26. The bubble chamber attaches to the engine by means of a base plate 15 placed between the bubble chamber and the engine. A retention bolt 7 holds the bubble chamber and plate 15 to the engine. Internal housing 32 includes a bottom wall 33 having openings 31, a side wall 34, and a removable top wall 35 held in place by bolts 39. Said walls of the internal housing are spaced within the walls of the external housing to define a closed, substantially annular conduit 28, the use of which will hereinafter be explained.

Within internal housing 32, and preferably integral therewith, are formed one or more air-fuel mixing conduits 40 in the form of venturi tubes defined by side walls 45. Side walls 45 in cooperation with walls 33,34, and 35 of the internal housing define an internal chamber 49 which opens, adjacent the top wall 35 into the venturi tubes 40. Walls 45 preferably are provided with or define a plurality of deflection members 48, all set at a selected angle to create a vortex of air and fuel vapor within each of the conduits 40 for thorough mixing of air and fuel vapor.

Contained within chamber 49 at the bottom thereof, are a multiplicity of catalytic beads 30, preferably consisting of platinum. A screen 44 located between opposing side walls of chamber 49 holds the catalytic beads in place, minimizes sloshing of the fuel, and effectively separates the chamber into a lower chamber holding fuel and beads and an upper chamber containing only an air and fuel vapor mixture.

To provide a proper air-fuel vapor ratio, i.e., for determining how rich or lean the mixture is to be, each of the venturi tubes 40 is provided with a mixing valve 50, preferably in the form of threaded needles 51 which engage mating threads formed in the top wall 35 of the internal housing 32 to allow a desired flow of air from the atmosphere, though air conduits 55 and through venturi air passages 58 into the venturi tubes. Rotation of the threaded needles 51 operates to open or close air passages 58 a selected amount in determining the richness of the mixture. The venturi tubes are in fluid communication with the intake manifold of the engine, not shown, through ports 80. To hold gasoline at a proper level within the bubble chamber; the level shown by the dotted lines, a conventional float bowl 60 having a float 63, both shown in schematic, is used. The float bowl is connected to and is in fluid communication with the bubble chamber by means of an adapter 68.

In operation, and assuming the engine has been started to create a vacuum within the intake manifold, the vacuum pulls air from the atmosphere, through the air preheating system and through air filter 6 into annular conduit 28, through gasoline 2 located within the conduit, and through openings 31 in bottom wall 33 of internal housing 32. The air then bubbles up through the gasoline located within chamber 49. It will be noted that the catalytic beads serve as a center of adsorption for both the heated fuel and air to provide a vaporous mixture and the beads also serve as a catalyst in contact with the gasoline for the cracking of long molecular chains of the composition into shorter chains. The super rich air-fuel vapor mixture in the upper portion of chamber 49 is then pulled by the vacuum into respective venturi tubes 40 through openings between venturi tubes and the upper portion of chamber 49, striking the deflection members 48 to create a vortex of air and fuel vapor mixture. Proper setting of mixing valves 50 allow a selected amount of air from the atmosphere to enter the venturi tubes to mix with the air and fuel vapor vortex which is then conducted through ports 80 into the intake manifold and hence to the engine cylinders for combustion.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A carburetor and fuel preconditioner for internal combustion engines comprising:

a bubble chamber operable to hold liquid fuel at a selected level therein, said bubble chamber provided with one or more air ports located below said fuel level for bubbling air through the fuel and said bubble chamber defining an air-fuel vapor chamber above said fuel level;

a multiplicity of catalytic beads located within said bubble chamber in contact with the fuel and with air drawn through said ports; and at least one air-fuel vapor mixing conduit in fluid communication between the vapor chamber of said bubble chamber and an intake manifold of the engine, said conduit provided with a mixing valve for controlling air-fuel ratio provided to the engine.

2. The carburetor and fuel preconditioner described in claim 1 wherein said mixing conduit is provided with a plurality of deflection members, each set at a selected angle to create a vortex of air-fuel vapor for thorough mixing of the air and fuel entering the intake manifold of the engine.

3. The carburetor and fuel preconditioner described in claim 1 wherein said catalytic beads include platinum.

4. The carburetor and fuel preconditioner described in claim 1 further comprising a screen located within said bubble chamber to hold said catalytic beads in place.

5. The carburetor and fuel preconditioner described in claim 1 further comprising fuel float means for controlling the fuel level within said bubble chamber.

6. A carburetor and fuel preconditioner for internal combustion engines comprising:

a bubble chamber operable to hold liquid fuel at a selected level therein, said bubble chamber provided with one or more air ports located below said fuel level for bubbling air through the fuel and said bubble chamber defining an air-fuel vapor chamber above said fuel level;

a multiplicity of platinum catalytic beads located within said bubble chamber in contact with the fuel and with air drawn through said ports; and at least one air-fuel vapor mixing conduit in fluid communication between the vapor chamber of said bubble chamber and an intake manifold of the engine, said conduit provided with a mixing valve for controlling air-fuel ratio provided to the engine and said mixing conduit provided with a plurality of deflection members, each set at a selected angle to create a vortex of air-fuel vapor for thorough mixing of the air and fuel entering the intake manifold of the engine.

7. A carburetor and fuel preconditioner as described in claim 6 further comprising a screen located within said bubble chamber to hold said catalytic beads in place.

8. A carburetor and fuel preconditioner for internal combustion engines comprising:

a bubble chamber including an external housing having side walls and a bottom wall and an internal housing located within said external housing and having side walls and a bottom wall spaced from said walls of said external housing to define a conduit therebetween, said bubble chamber operable to hold liquid fuel at a selected level therein, said internal housing of said bubble chamber provided with one or more air ports located below said fuel level and in fluid communication with said conduit for bubbling air through the fuel and said bubble chamber defining an air-fuel vapor chamber above said fuel level;

a multiplicity of catalytic beads located within said bubble chamber in contact with the fuel and with air drawn through said ports; and at least one air-fuel vapor mixing conduit in fluid communication between the vapor chamber of said bubble chamber and an intake manifold of the engine, said conduit provided with a mixing valve for controlling air-fuel ratio provided to the engine.

9. The carburetor and fuel preconditioner described in claim 8 wherein said mixing conduit is provided with a plurality of deflection members, each set at a selected angle to create a vortex of air-fuel vapor for thorough mixing of the air and fuel entering the intake manifold of the engine.

10. The carburetor and fuel preconditioner described in claim 8 wherein said catalytic beads include platinum.

11. The carburetor and fuel preconditioner described in claim 8 further comprising a screen located within said bubble chamber to hold said catalytic beads in place.

12. The carburetor and fuel preconditioner described in claim 8 further comprising fuel float means for controlling the fuel level within said bubble chamber.

* * * * *